United States Patent [19]

Maruko

[11] Patent Number: 4,798,192

[45] Date of Patent: Jan. 17, 1989

[54] FAR-INFRARED RADIATING SYSTEM

[75] Inventor: Saburo Maruko, Yamato, Japan

[73] Assignee: Nippon Chemical Plant Consultant Co., Ltd., Tokyo, Japan

[21] Appl. No.: 100,057

[22] Filed: Sep. 23, 1987

[30] Foreign Application Priority Data

Sep. 24, 1986 [JP] Japan ..... 61-223844

[51] Int. Cl.[4] ..... F24C 3/00

[52] U.S. Cl. ..... 126/91 A; 126/92 AC; 126/92 B; 431/328

[58] Field of Search ..... 126/91 A, 91 R, 92 AC, 126/92 R, 92 B; 431/351, 353, 188, 328

[56] References Cited

U.S. PATENT DOCUMENTS

| | | | |
|---|---|---|---|
| 2,897,337 | 7/1959 | Schiff | 126/92 A |
| 2,946,510 | 7/1960 | Galvin | 126/91 A |
| 4,044,751 | 8/1977 | Johnson | 126/91 A |
| 4,529,123 | 7/1985 | Johnson | 126/92 AC |

FOREIGN PATENT DOCUMENTS

| | | | |
|---|---|---|---|
| 1096413 | 7/1955 | France | 126/91 A |
| 80637 | 7/1981 | Japan | 126/91 R |
| 48423 | 3/1985 | Japan | 126/91 R |

*Primary Examiner*—James C. Yeung

*Attorney, Agent, or Firm*—Armstrong, Nikaido, Marmelstein & Kubovcik

[57] ABSTRACT

A far-infrared radiating system comprises a far-infrared radiating element (2) such as a ceramic, adhered to a metallic material (1) and radiating far-infrared rays upon heating. The system is constructed of a primary-radiating element (5) which is made of a metallic material while heated by a combustion gas passing therethrough and a secondary-radiating element (3) provided with the far-infrared radiating element (2) adhered to the metallic material (1). The primary-radiating element (5) is spaced apart and oppositely disposed from the secondary-radiating element (3) which is heated by infrared rays radiated from the primary-radiating element (5) having been heated with a combustion gas passing therethrough, whereby the secondary-radiating element (3) radiates far-infrared rays.

9 Claims, 2 Drawing Sheets

FAR-INFRARED RADIATING SYSTEM

BACKGROUND OF THE INVENTION

1. Field of the Invention

The present invention relates to a far-infrared radiating system employing a far-infrared radiating element which radiates far-infrared rays upon heating.

2. Description of the Prior Art

Hitherto, in a conventional type of such far-infrared radiating system, a heat source thereof is provided by an electric heater or a combustion gas produced in a burner or a catalyst unit.

The heat source employing the electric heater is disadvantageous in its operation cost. On the other hand, the heat source employing the combustion gas suffers from a problem that, since a temperature of the combustion gas is generally too high in use, a temperature of a far-infrared radiating element becomes too high to cause energy densities of far-infrared rays to become high, i.e., to cause wavelengths of the far-infrared rays to become short.

When an organic material which has an upper limit of allowable temperature is irradiated with the far-infrared rays having short wavelengths or high energy densities in order to dry the organic material, a temperature of a peripheral portion of the thus irradiated organic material is exclusively increased to produce a considerable difference in temperature between the peripheral portion of the organic material and an interior portion of the same.

In this case, in order to eliminate such difference in temperature of the irradiated organic material, it is necessary to employ far-infrared rays having long wavelengths or low energy densities in heating of the organic material, which heating is conducted for a relatively long period of time by the use of the far-infrared radiating element which is kept relatively low in temperature while provided with a relatively large radiating area.

However, in order to keep the far-infrared radiating element low in temperature, it is necessary to feed a large amount of a secondary combusting gas to the large radiating area of the far-infrared radiating element, which secondary combustion gas is prepared by mixing a primary combustion gas with a large amount of air so as to decrease a temperature of the secondary combustion gas. Consequently, in this case, there is a defect in that such large amount of the secondary combustion gas has a high consumption of power in its feeding operation.

On the other hand, in case that a multistage catalytic-combustion process is employed in order to increase a thermal efficiency of the far-infrared radiating system, there is another defect in that a large amount of a catalyst must be employed in such multistage catalytic-combustion process to ensure a low-temperature combustion operation, which leads to a large amount of pressure loss of a combustion gas which is produced in such low-temperature combustion operation and is forced to pass through a layer of the large amount of the catalyst with a high consumption of power.

SUMMARY OF THE INVENTION

It is an object of the present invention to provide a far-infrared radiating system in which a relatively small amount of a combustion gas is employed a temperature of which ranges over a relatively wide range in a high temperature area so that a primary-radiating element having a small radiating surface is heated with the use of a sensible heat of such combustion gas to radiate a large amount of radiating energy from the small radiating surface thereof, which radiating energy is received by a large surface of a metallic plate which adheres to a far-infrared radiating element to constitute a secondary-radiating element, whereby the secondary-radiating element is heated to radiate, in the form of far-infrared rays having long wavelengths, the same amount of energy as that radiated from the primary-radiating element, which enables the far-infrared radiating system to efficiently radiate the far-infrared rays from a large area of the secondary-radiating element thereof with a low consumption of power.

The far-infrared radiating system of the present invention has the following construction: a far-infrared radiating system comprising a far-infrared radiating element such as a ceramic, adhered to a metallic material and radiating far-infrared rays upon heating, characterized in that: said far-infrared system is constructed of a primary-radiating element which is made of a metallic material while heated by a combustion gas passing therethrough and a secondary-radiating element provided with a far-infrared radiating element adhered to a metallic material; said primary-radiating element is spaced apart and is oppositely disposed from said secondary-radiating element; and said secondary-radiating element is heated by infrared rays radiated from said primary-radiating element having been heated with the use of a sensible heat of a combustion gas passing through said primary-radiating element, whereby said secondary-radiating element radiates far-infrared rays.

In the far-infrared radiating system of the present invention having the above construction, the infrared rays radiated from the primary-radiating element are large in energy density or relatively short in wavelength, while the secondary-radiating element is heated at its large area by such infrared rays so that a temperature of the thus heated secondary-radiating element is kept relatively low to make it possible that the secondary-radiating element radiates far-infrared rays having relatively low energy densities or relatively long wavelengths.

DESCRIPTION OF THE PREFERRED EMBODIMENTS

Figure 1:
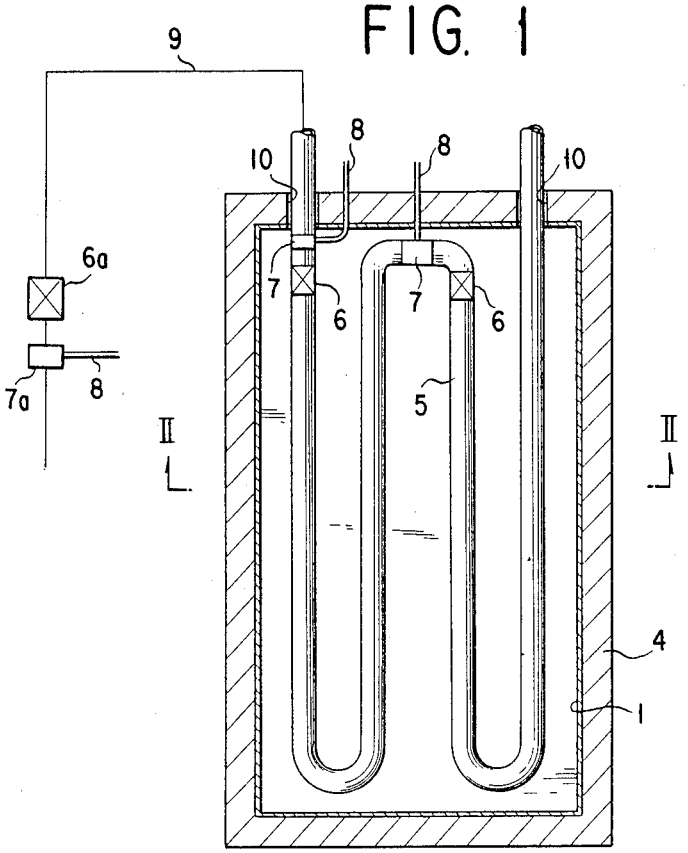
FIG. 1 is a sectional plan view of an essential part of the far-infrared radiating system comprising a preheated-air feed line of a first embodiment of the present invention.

Hereinbelow will be described in detail embodiments of the far-infrared radiating system of the present invention with reference to the drawings.

In the drawings: the reference numeral 1 denotes a box; 2, 13 and 19 far-infrared radiating elements; 3 a secondary-radiating element; 5, 11 and 16 combustion-gas conduits; 6 and 6a catalytic-combustion unit; and 7 and 7a fuel mixers or carburetors.

Figure 2:
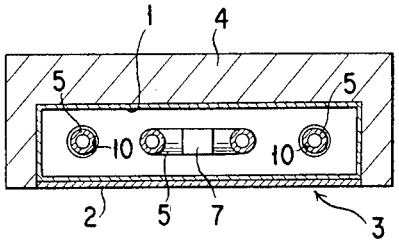
FIG. 2 is a cross-sectional view of the essential part of the far-infrared radiating system of the present invention, taken along the line 11—11 of FIG. 1.

As shown in FIGS. 1 and 2, the box 1 is constructed of a metallic plate and assumes a broad, flat rectangular form in cross section. A long side of wall portions of the box 1 forms a supporting element an outer surface of which is coated with the far-infrared radiating element 2 such as a ceramic in a bonding manner so that such long side of the wall portions of the box 1 constitutes the secondary-radiating element 3. The remaining sides of the wall portions of the box 1 are covered with a heat-insulating material 4. Inner surfaces of such remaining sides of the wall portions of the box 1 are aluminized or constructed of a polished stainless steel to increase reflectances thereof.

As shown in FIG. 1, the combustion-gas conduit 5 is arranged in the box 1 to assume a staggered form. Staggered portions of the conduit 5 are spaced apart from the inner surface of the secondary-radiating element 3 of the box 1 by a predetermined distance while oppositely disposed therefrom over the entire area of the inner surface of the secondary-radiating element 3. This combustion-gas conduit 5 constitutes a primary-radiating element for heating the inner surface of the secondary-radiating element 3 of the box 1. A plurality of catalytic-combustion units 6 are provided in an inlet and an intermediate portions of the combustion-gas conduit 5. A plurality of carburetors or mixers 7 for mixing a fuel with air are provided in an upstream side of each of the catalytic-combustion units 6. A fuel-feed tube 8 is connected to each of the mixer 7.

The inlet portion of the combustion-gas conduit 5 is connected with a preheated-air feed line 9 which is provided with a preheating mixer 7a and a preheating catalytic-combustion unit 6a. A suitable air-feed unit such as a blower is provided in an upstream side of the preheating mixer 7a.

An outlet portion of the combustion-gas conduit 5 opens to the atmosphere through a heat exchanger or is connected to an inlet portion of another far-infrared radiating system. Incidentally, the above heat exchanger is provided in the preheated-air feed line 9. The box 1 is provided with a vent opening 10 for permitting the interior of the box 1 to communicate with open air.

In the first embodiment of the far-infrared radiating system of the present invention having the above construction, an area "$A_1$" of a radiating surface of the combustion-gas conduit 5 constituting the primary-radiating element is less than an area "$A_2$" of a radiating surface of the long side of the wall portion of the box 1, which long side constitutes the secondary-radiating element 3.

Further, in the above construction, a preheated air is fed from the preheated-air feed line 9 to the combustion-gas conduit 5 in which the preheated air or a combustion gas is mixed with a fuel fed from each of the fuel-feed tubes 8 to produce a gaseous mixture which is oxidized through each of the catalytic-combustion units 6 to produce a combustion gas having a temperature of less than 1000° C. As a result, the combustion-gas conduit 5 is heated by such combustion gas to radiated infrared rays from its surface. Although the entire inner surface of the box 1 is irradiated with such infrared rays, the inner surface except a back surface of the secondary-radiating element 3 reflects the infrared rays on the back surface of the secondary-radiating element 3 to heat the secondary-radiating element 3 as a whole. At this time, the thus radiated rays are changed in energy density or wavelength on the basis of a difference in area of radiating surface between the primary-radiating element 5 and the secondary-radiating element 3, so that the secondary-radiating element 3 radiates far-infrared rays, which are longer in wavelength than the infrared rays, from its far-infrared radiating element 2.

In the first embodiment of the far-infrared radiating system of the present invention described in the above, in order to increase a radiating amount of the infrared rays, it is preferable that the surface of the combustion-gas conduit 5 is coated with a ceramic and the like applied thereto by the use of flame spray coating techniques and like techniques. In addition, the far-infrared radiating element 2 of the secondary-radiating element 3 is preferably made of a black material as close as possible to a perfect black body. Although the ceramic serves as the far-infrared radiating element in a conventional far-infrared radiating system, a thermal emissivity of the ceramic is 0.92 at maximum. In contrast with this, a thermal emissivity of graphite is within a range of from 0.97 to 0.98, which is higher than that of the ceramic. The graphite is oxidized at a temperature of at least 450° C. to cause a wastage of oxidization thereof. However, in the far-infrared radiating system of the present invention, since the secondary-radiating element 3 is not heated to a temperature of more than 450° C., it is possible to employ the graphite as a material of the far-infrared radiating element 2 of the secondary-radiating element 3, which leads to a great advantage inherent in the far-infrared radiating system of the present invention.

Since the combustion-gas conduit 5 disposed in the box 1 is heated by the sensible heat of the combustion gas passing through the conduit 5 through a metallic wall thereof, the temperature of the radiating surface of the combustion-gas conduit 5 decreases at a downstream side of the conduit 5.

In order to compensate such decrease in temperature occurring in the downstream side of the combustion-gas conduit 5, a plurality of catalytic-combustion units 6 are provided in the combustion-gas conduit at predetermined intervals. In addition to this, pitch of the staggered form of the combustion-gas conduit 5 is preferably decreased at the downstream side of the conduit 5 so as to increase a radiated area of the back surface of the secondary-radiating element 3. As a result, the back surface of the secondary-radiating element 3 is uniformly irradiated with the infrared rays radiated from the primary-radiating element or combustion-gas conduit 5.

Figure 3:
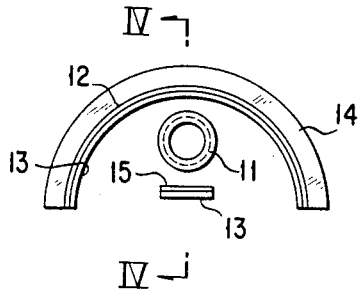
FIG. 3 is a front view of a second embodiment of the far-infrared radiating system of the present invention.
Figure 4:
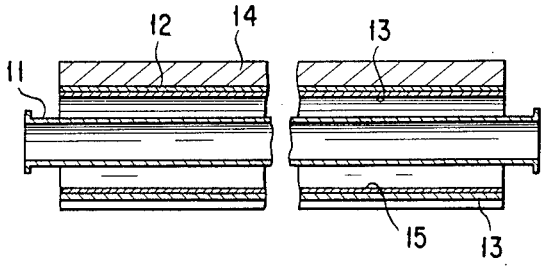
FIG. 4 is a longitudinal sectional view of the second embodiment of the far-infrared radiating system of the present invention, taken along the line IV—1V of FIG. 3.

A second embodiment of the far-infrared radiating system of the present invention is shown in FIGS. 3 and 4, in which: the reference numeral 11 denotes the combustion-gas conduit constituting the primary-radiating element; 12 a semicylindrical metallic member which is disposed over the combustion-gas conduit 5 while oriented at its open side downward; 13 the far-infrared radiating element adhered to an lower surface of the semicylindrical member 12; 14 a heat insulating material adhered to an upper surface of the semicylindrical member 12; 15 a metallic plate which is disposed under the combustion-gas conduit 5 for preventing the infrared rays from being radiated downward from the combustion-gas conduit 5. A lower surface of the metallic plate 15 is also coated with the far-infrared radiating element 13.

In the second embodiment of the far-infrared radiating system of the present invention having the above construction, the combustion-gas conduit 5 constitutes the primary-radiating element for radiating the infrared rays. On the other hand, any of the semicylindrical metallic member 12, far-infrared radiating member 13 and the metallic plate 15 constitutes the secondary-radiating element to be heated by the infrared rays radiated from the primary-radiating element of combustion-gas conduit 5, so that the secondary-radiating elements 12, 13 and 15 radiate the far-infrared rays downward.

Figure 5:
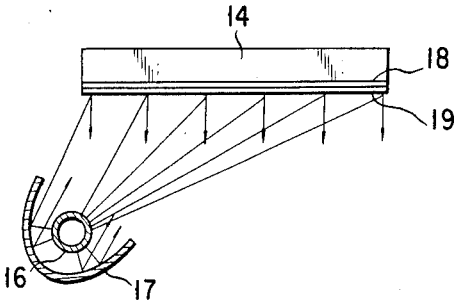
FIG. 5 is a front view of a third embodiment of the far-infrared radiating system of the present invention.

A third embodiment of the far-infrared radiating system of the present invention is shown in FIG. 5, in which the reference numeral 16 denotes the combustion-gas conduit which is disposed in a U-shaped metallic reflecting member 17 which is oriented at its open side upward and outward. An inner surface of the reflecting member 17 is mirror-finished to provide an excellent reflectance. The metallic plate 18 serving as a supporting element is coated at its lower surface with the far-infrared radiating element 19 so as to form the secondary-radiating element.

In this third embodiment of the far-infrared radiating system of the present invention having the above construction, the infrared rays radiated from the combustion-gas conduit 16 constituting the primary-radiating element directly hit the far-infrared radiating element 19 of the secondary-radiating element or are reflected by the reflecting member 17 onto the far-infrared radiating element 19 to heat the element 19 so as to cause the same 19 to radiate the far-infrared rays downward.

Incidentally, in this third embodiment of the far-infrared radiating system of the present invention, it is also possible to coat a back surface of the reflecting member 17 with the far-infrared radiating element so as to make it possible that the far-infrared radiating element thus coated on the back surface of the reflecting member 17 radiates the far-infrared rays upon heating.

As described in the above, the far-infrared radiating system of the present invention can efficiently radiate the far-infrared rays from its large radiating surface with a low consumption of power.

What is claimed is:

1. A far-infrared radiating system comprising:

a primary-radiating element for radiating far-infrared rays having short wavelengths upon being heated, said primary-radiating element being a metallic conduit through which a catalytic-combustion-gas flow can pass to heat the same and a first far-infrared radiating element adhered closely to an outer periphery of said conduit, and a secondary-radiating element comprising a metallic plate and a second far-infrared radiating element adhered to one surface of said plate, said secondary-radiating element having a wider surface area than that of said primary-radiating element and being spaced apart and oppositely disposed from said primary-radiating element, wherein far-infrared rays having long wavelengths are radiated upon heating said secondary-radiating element by receiving said far-infrared rays having short wavelengths from said primary-radiating element.

2. The far-infrared radiating system as set forth in claim 1, wherein said metallic plate is semi-cylindrical and encircles said primary-radiating element.

3. The far-infrared radiating system as set forth in claim 2, wherein said second far-infrared radiating element is provided on said one surface of said plate facing said primary-radiating element.

4. The far-infrared radiating system as set forth in claim 3, wherein a surface of said plate opposite said one surface is coated with a heat insulating material.

5. The far-infrared radiating system as set forth in claim 4 wherein said secondary-radiating element further comprises a second metallic plate positioned relative to said metallic plate so as to sandwich said primary-radiating element therebetween and a third far-infrared element adhered to a surface of said second metallic plate facing away from said primary-radiating element.

6. The far-infrared radiating system as set forth in claim 1, wherein: said primary-radiating element is provided inside a box an outer peripheral surface of which is coated with a far-infrared radiating element.

7. The far-infrared radiating system as set forth in claim 1, wherein : said primary-radiating element is oppositely disposed from said far-infrared radiating element of said secondary-radiating element; and both said primary-radiating element and said secondary-radiating element are covered with a heat insulating material except their oppositely disposed portions.

8. The far-infrared radiating system as set forth in claim 1, wherein: said primary-radiating element is encircled with a reflecting member having a U-shaped cross section; and an open side of said reflecting member is oriented upward and outward toward said secondary-radiating element.

9. The far-infrared radiating system as set forth in claim 1, wherein: an outer surface of said reflecting member is coated with a far-infrared radiating element.

* * * * *